US006945836B1

(12) United States Patent
Lorier

(10) Patent No.: US 6,945,836 B1
(45) Date of Patent: Sep. 20, 2005

(54) TOWABLE NAUTICAL DEVICE FOR LEISURE SPORT

(76) Inventor: Roberto Roger Lorier, 4 rue du Faisan, Haubourdin (FR) 59320

( * ) Notice: Subject to any disclaimer, the term of this patent is extended or adjusted under 35 U.S.C. 154(b) by 0 days.

(21) Appl. No.: 09/914,215

(22) PCT Filed: Feb. 25, 2000

(86) PCT No.: PCT/FR00/00478

§ 371 (c)(1),
(2), (4) Date: Dec. 6, 2002

(87) PCT Pub. No.: WO00/50300

PCT Pub. Date: Aug. 31, 2000

(30) Foreign Application Priority Data

Feb. 25, 1999 (FR) ..... 99 02530

(51) Int. Cl.[7] ..... B63B 7/08
(52) U.S. Cl. ..... 441/66; 114/345; 114/253
(58) Field of Search ..... 114/345, 253, 254; 441/40, 65, 66, 129

(56) References Cited

U.S. PATENT DOCUMENTS

| | | | | |
|---|---|---|---|---|
| 2,986,751 A | | 6/1961 | Baren | |
| 3,455,571 A | * | 7/1969 | Dallera et. al. | 280/18 |
| 3,605,148 A | | 9/1971 | Tailer | |
| 3,785,317 A | | 1/1974 | Currey | |
| 5,006,087 A | | 4/1991 | Peterson | |
| 5,604,945 A | * | 2/1997 | Fisher et al. | 5/706 |

FOREIGN PATENT DOCUMENTS

| | | |
|---|---|---|
| DE | 88 11 319 | 10/1988 |
| FR | 1 039 886 | 10/1953 |
| FR | 1 279 985 | 5/1962 |
| FR | 1 477 564 | 7/1967 |
| FR | 2 422 550 | 11/1979 |
| GB | 170 356 | 10/1921 |
| NL | 7 903 845 | 11/1980 |
| WO | WO 86/07025 | 12/1986 |

* cited by examiner

*Primary Examiner*—Sherman Basinger
(74) *Attorney, Agent, or Firm*—Darby & Darby

(57) ABSTRACT

A towable non-powered nautical device for aquatic leisure sport is lifted at the front when pulled, or towed, and is sometimes altogether lifted out of the water. The nautical device can carry one or more persons and includes a front inflatable structure equipped in its lower part with a towing attachment, at least one inflatable elongated secondary stucture, at least an inflatable elongated auxiliary structure, retainers for passengers who are standing, seated, lying down, or positioned astride on the secondary structure, on each side of a flexible lateral skirt.

22 Claims, 2 Drawing Sheets

TOWABLE NAUTICAL DEVICE FOR LEISURE SPORT

TECHNICAL FIELD

The present invention relates to a nautical device, and more specifically, to a non-motorised towable nautical device for a collective aquatic leisure activity, which may be lifted out of the liquid element during use.

BACKGROUND

Certain inflatable, non-motorised towable nautical devices, which are traditionally long in shape, offer solely the possibility for passengers to sit placed one behind the other and to follow the movements of the waves.

SUMMARY

Passengers on a nautical device, according to the present invention, can be positioned one behind the other and/or side-by-side. The front of the nautical device moves upward in accordance with its towing speed in a progressively vertical fashion against the liquid element, e.g., water. The nautical device can bounce from wave to wave and on occasion, can be lifted altogether out of the water.

The nautical device, according to an embodiment of the present invention, includes an inflatable front structure and secondary structures. The front structure is generally cylindrical and is made from a material such as Hypalon neoprene. The secondary structures are disposed perpendicular to the front structure and include at least two inflatable structures that are generally cylindrical.

DETAILED DESCRIPTION OF THE PREFERRED EMBODIMENTS

Figure 1:
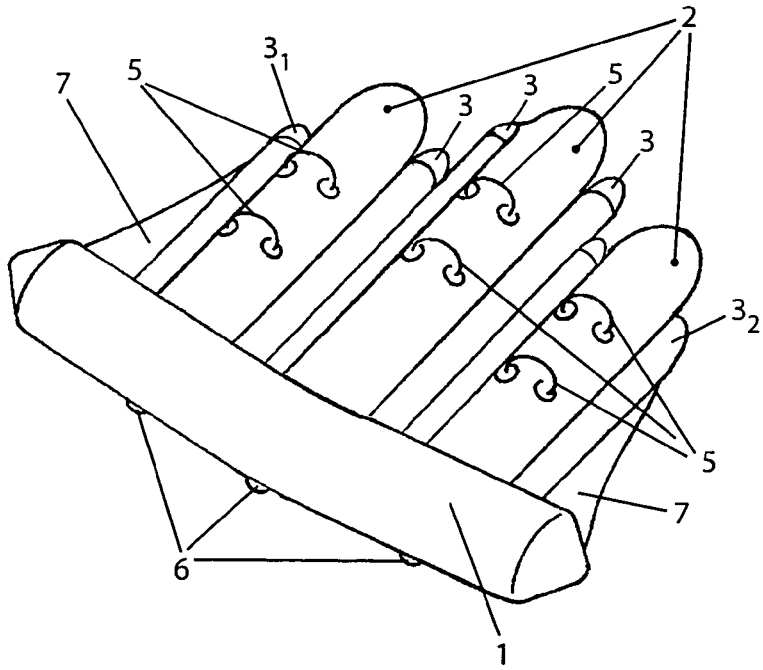
FIG. 1 is a perspective view of a nautical device according to an embodiment of the present invention.

FIG. 1 is a perspective view of a nautical device according to an embodiment of the present invention. The nautical device is a non-motorised towable device that is lifted from the front when towed and that can be lifted altogether out of the water or other liquid element on occasion during use. The nautical device can be used for an aquatic leisure activity.

The nautical device, as shown in FIG. 1, includes a front structure 1, at least two secondary structures 2, at least one auxiliary structure $\mathbf{3},\mathbf{3}_1,\mathbf{3}_2$, and at least one retainer 5 or other device to allow one or more passenger to hold on to the nautical device.

The front structure 1 is preferably inflatable and elongated uniquely in a principal direction that is perpendicular to the direction of movement of the nautical device.

The secondary structures 2 are inflatable and elongated. One end of each of the secondary structures 2 interlocks with an inner side (towards the center of the nautical device) of the front structure 1. In the embodiment of the invention shown in FIG. 1, the secondary structures 2 do not interlock with the closed ends of the front structure 1 which extend outward from the sides of the nautical device.

The nautical device can include one or more of the auxiliary structures $\mathbf{3},\mathbf{3}_1,\mathbf{3}_2$ shown in FIG. 1. The auxiliary structures $\mathbf{3},\mathbf{3}_1,\mathbf{3}_2$ are elongated and can be inflatable or non-inflatable. The auxiliary structures $\mathbf{3},\mathbf{3}_1,\mathbf{3}_2$ can each have a cross section that is smaller than the cross section of the secondary structures 2 and can link with the secondary structures 2 in a parallel manner to provide maximum buoyancy. One or more of the auxiliary structures $\mathbf{3},\mathbf{3}_1,\mathbf{3}_2$ can be optionally juxtaposed together in groups to link the secondary structures 2.

The secondary structures 2 and the auxiliary structures $\mathbf{3},\mathbf{3}_1,\mathbf{3}_2$ are disposed parallel to each other along the principal direction of movement of the nautical device and are approximately perpendicular to the principal direction of the front structure 1. The secondary structures 2 and the auxiliary structures $\mathbf{3},\mathbf{3}_1,\mathbf{3}_2$ are not linked by a rear structure, and therefore, rear ends of the secondary structures 2 and the auxiliary structures $\mathbf{3},\mathbf{3}_1,\mathbf{3}_2$ are not linked.

The front structure 1 shown in FIG. 1 includes on its lower part a towing attachment 6 to facilitate the lifting of the front of the nautical device when towed, e.g., by a towing boat. The towing attachment 6 is preferably attached to the lower part of the front structure 1 under the floatation line.

The towing attachment 6 shown in FIG. 1 includes at least two attachment points that are fixed to the front structure 1 at positions that align with the secondary structures 2 relative to the direction of movement of the nautical device.

The towing attachment 6 shown in FIG. 1 includes at least two towing elements, e.g., lines, that are linked to a central point on a front external part of the nautical device. The front external part of the nautical device is linked to the towing element, which is linked to the towing boat.

The front structure 1 is approximately semicircular or delta-wing shaped having closed ends and expands approximately towards the rear and/or the side of the nautical device. The front structure 1 can include at least two straight segments linked together having closed ends that extend approximately towards the rear and/or the side of the nautical device.

Figure 2:
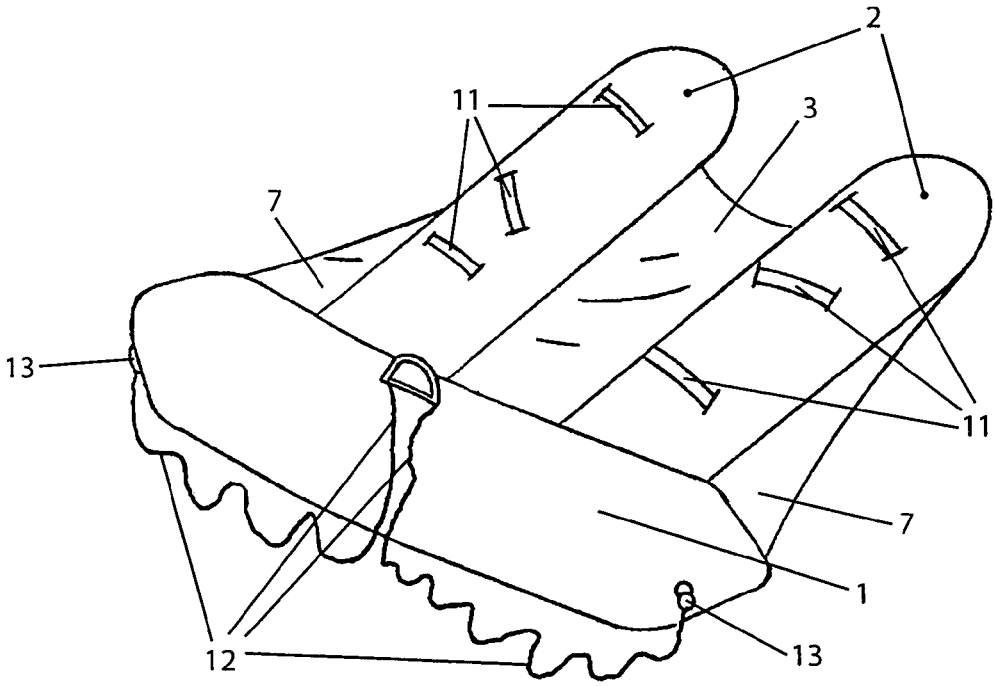
FIG. 2 is a perspective view of a nautical device according to another embodiment of the present invention.

The nautical device includes a flexible and supple lateral skirt 7 along each side. The lateral skirts 7 are triangular and link the side of the front structure 1 to either auxiliary structures $\mathbf{3}, \mathbf{3}_1,\mathbf{3}_2$ (FIGS. 1 and 3) or to the most external lateral secondary structures 2 (FIG. 2).

The various different inflatable structures terminate in unlinked rear ends with an approximately conical, semi-spherical or ovoid form.

Straps and/or foot chocks 11 can be provided to allow the passenger(s) to hold on to the nautical device. The passenger(s) can stand upright, lie down, sit, or sit astride the secondary structures 2.

As shown in FIG. 1, the nautical device includes three secondary structures 2, and the central secondary structure 2 is linked on each side by an auxiliary inflatable structure 3. The two secondary structures 2 on either side of the central secondary structure 2 are joined by auxiliary structures $\mathbf{3},\mathbf{3}_1,\mathbf{3}_2$ to form triangular profiles that extend towards the rear of the nautical device. The devices that allow the passengers to hold on to the nautical device, e.g., retainers 5, are disposed principally on the secondary structures 2.

FIG. 2 is a perspective view of a nautical device according to another embodiment of the present invention. According to this embodiment of the invention, the nautical device includes at least two secondary structures 2 linked by at least one auxiliary structure 3 that is distinctively flat. The nautical device also includes a device for allowing directional control for the nautical device, such as a cord 12 fixed to each end 13 of the front structure 1 to allow at least one of the passengers, who is typically standing upright, to steer the nautical device.

Figure 3:
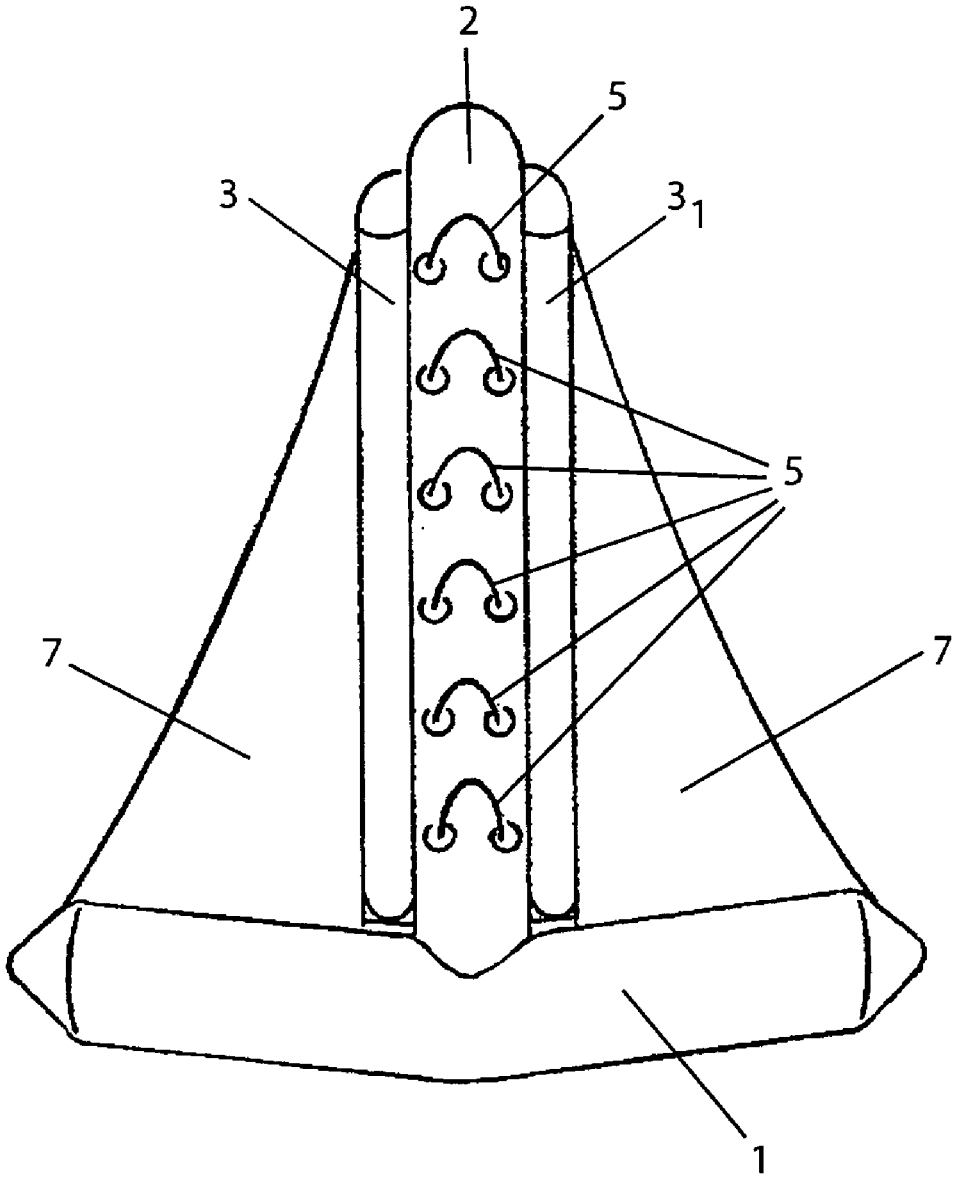
FIG. 3 is a top view of a nautical device according to a further embodiment of the present invention.

FIG. 3 is a top view of a nautical device according to a further embodiment of the present invention. The nautical device shown in FIG. 3 is a non-motorised towable nautical device that is lifted from the front when towed and that can leave the water or other liquid element on occasion during use. The nautical device can be used for an aquatic leisure activity.

The nautical device, as shown in FIG. 3, includes the front structure 1, one secondary structure 2, two auxiliary structures $\mathbf{3},\mathbf{3}_1$, and at least one strap and/or foot chock and/or other device, e.g., retainer 5, to allow the passenger(s) to hold on to the nautical device.

The front structure 1 is preferably inflatable and elongated uniquely in a principal direction that is perpendicular to the direction of movement of the nautical device.

The secondary structure 2 is inflatable and elongated. One end of the secondary structure 2 interlocks on an inner side (towards the center of the nautical device) of the front structure 1. In the embodiment of the invention shown in FIG. 3, the secondary structure 2 does not interlock with the closed ends of the front structure 1 which extend outward from the sides of the nautical device.

The nautical device can include one or more of the auxiliary structures $\mathbf{3},\mathbf{3}_1$ shown in FIG. 3. The auxiliary structures $\mathbf{3},\mathbf{3}_1$ are elongated and inflatable. The auxiliary structures $\mathbf{3},\mathbf{3}_1$ each include a cross section that is smaller than the cross section of the secondary structure 2 and that links with the secondary structure 2 in a parallel manner to provide maximum buoyancy.

The secondary structure 2 and the auxiliary structures $\mathbf{3},\mathbf{3}_1$ are disposed parallel to each other along the principal direction of movement of the nautical device and are approximately perpendicular to the principal direction of the front structure 1. The secondary structure 2 and the auxiliary structures $\mathbf{3},\mathbf{3}_1$ are not linked by a rear structure, and therefore, rear ends of the secondary structure 2 and the auxiliary structures $\mathbf{3},\mathbf{3}_1$ are not linked.

The front structure 1 is approximately semicircular or delta-wing shaped having closed ends and expands approximately towards the rear and/or the side of the nautical device.

The towing attachment 6 can be attached to the lower part of the front structure 1 under the floatation line. The flexible lateral skirt 7 is fixed to the front structure 1 on the sides of the nautical device, is triangular, and links the sides of the front structure 1 to the auxiliary structures $\mathbf{3}, \mathbf{3}_1$.

The entire nautical device can be composed of hollow or solid rigid structures that are made, for example, from one of the following materials: plastic, reinforced fibreglass resin, and composite material.

Alternatively, the entire nautical device can be composed of inflatable structures made from supple or watertight materials, for example, from one of the following materials: rubber, PVC, and Hypalon neoprene.

At least one of the auxiliary structures $\mathbf{3},\mathbf{3}_1,\mathbf{3}_2$ is made from supple or watertight materials, for example, from one of the following materials: rubber, PVC, and Hypalon neoprene.

According to the present invention, special methods have been described for, first, incorporating the perpendicular secondary structure(s) 2 in the front structure 1 and second, constructing the front structure 1.

Each secondary structure 2, which are perpendicular to the front structure 1, can accommodate one or more passengers sitting or standing one behind the other or side by side.

At each side of the perpendicular secondary structures 2, one or more smaller auxiliary structures $\mathbf{3},\mathbf{3}_1,\mathbf{3}_2$ can be used as foot rests and stabilisers while ensuring better buoyancy for the nautical device. The ends of the different inflatable structures are cone-shaped or of any other shape in which the ends may be terminated. Retainers, such as straps or any other device, can be fixed in any useful place on the nautical device to improve the foothold of the passenger(s).

The different structures are interlocked together either by adhesives and/or welding and/or sewing. The inflatable structures can incorporate one or more independent compartments to increase safety. Regarding the question of submergibility, the inflatable secondary structures can be interlocked with the front structure by inserting one end of the secondary structures into the front structure with fasteners or by adhesives and/or welding and/or sewing.

What is claimed is:

1. A towable non-motorized nautical device for aquatic leisure activity having a front part that is capable of being lifted up from a liquid in which the nautical device is disposed when towed, said nautical device comprising:

an inflatable front structure elongated along a direction perpendicular to a direction of movement of the nautical device and comprising at least one closed end on a side of the nautical device;

at least two elongated inflatable secondary structures each having an end that is interlocked to an inner side of the front structure at a predetermined distance from the at least one closed end of the front structure;

at least one elongated auxiliary structure with a cross section that is smaller than a cross section of the secondary structures, linking the secondary structures in a parallel manner, and being able to be juxtaposed together in groups to link the secondary structures; and at least one retainer for a passenger of the nautical device to hold on to;

wherein the secondary and auxiliary structures lie parallel to each other along the direction of movement of the nautical device and are approximately perpendicular to the direction of elongation of the front structure, and wherein rear ends of the secondary and auxiliary structures are not linked.

2. The nautical device according to claim 1, wherein the front structure comprises a towing attachment on a lower part of the front structure under a floatation line to facilitate the lifting of the front part of the nautical device when towed.

3. The nautical device according to claim 1, wherein the front structure comprises at least two attachment points for towing the nautical device, the at least two attachment points being aligned with the secondary structures relative to the direction of movement of the nautical device.

4. The nautical device according to claim 1, wherein:

the front structure is formed with at least one of the shapes selected from the group consisting of an approximately semicircular and a delta-wing shape with closed ends, and the front structure extends approximately towards at least one of a rear and the side of the nautical device.

5. The nautical device according to claim 1, wherein the front structure is formed with at least one of the shapes selected from the group consisting of an approximately semicircular and a wing shape; and the front structure comprises at least two straight segments linked together and each having a closed end, the at least two straight segments extending approximately towards at least one of a rear and the side of the nautical device.

6. The nautical device according to claim 1, further comprising a flexible lateral skirt along each side of the nautical device, linking the inner side of the front structure to at least one of the auxiliary structures and at least one secondary structure positioned toward an exterior of the nautical device.

7. The nautical device according to claim 1, wherein the inflatable structures terminate in unlinked ends with one of an approximately conical, semi-spherical, and ovoid form.

8. The nautical device according to claim 1, wherein the at least one retainer for the passenger to hold on to is at least one of a strap and a foot chock.

9. The nautical device according to claim 1, wherein the at least one retainer for the passenger to hold on to allows the passenger to do one of stand upright, lie down, sit and sit astride on at least one of the secondary structures.

10. The nautical device according to claim 1, further comprising:

a cord fixed to each end of the front structure to allow the passenger to steer the nautical device while standing upright, wherein the at least two secondary structures are flat and linked by the at least one auxiliary structure.

11. The nautical device according to claim 1, wherein:

the at least two elongated inflatable secondary structures comprise three secondary structures comprising a central secondary structure and two adjacent secondary structures on either side of the central secondary structure, the central secondary structure is linked at each of the the sides to one of the at least one auxiliary inflatable structure, the two adjacent secondary structures are each joined to one of the at least one auxiliary inflatable structure positioned between the adjacent secondary structures, the secondary structures and auxiliary structures forming triangular profiles extending towards the rear of the nautical device at a rear part of the nautical device, and the at least one retainer is principally situated on at least one of the secondary structures.

12. A towable non-motorized nautical device for aquatic leisure activity having a front part that is capable of being lifted up from a liquid in which the nautical device is disposed when towed, said nautical device comprising:

an inflatable front structure elongated along a direction perpendicular to a direction of movement of the nautical device and comprising at least one closed end on a side of the nautical device;

an elongated inflatable secondary structure having an end that is interlocked to an inner side of the front structure at a predetermined distance from the at least one closed end of the front structure;

two elongated auxiliary structures each with a cross section that is smaller than a cross section of the secondary structure and linking to the secondary structure in a parallel manner; and at least one retainer for a passenger of the nautical device to hold on to;

a towing attachment on the front structure disposed under a floatation line; and a flexible lateral skirt on each side of the nautical device, linking the inner side of the front structure to at least one of the auxiliary structures;

wherein the secondary and auxiliary structures lie parallel to each other along the direction of movement of the nautical device and are approximately perpendicular to the direction of elongation of the front structure, wherein rear ends of the secondary and auxiliary structures are not linked, wherein the front structure is formed with at least one of the shapes selected from the group consisting of an approximately semicircular and a delta-wing shape with closed ends, and wherein the front structure extends approximately towards at least one of a rear and the side of the nautical device.

13. The nautical device according to claim 1, wherein the front structure, the at least two secondary structures, and the at least one auxiliary structure comprise at least one of a hollow and a solid rigid structure made from one of the following materials:

a plastic material, a reinforced fibreglass resin, and a composite material.

14. The nautical device according to claim 1, wherein the front structure, the at least two secondary structures, and the at least one auxiliary structure comprise at least one inflatable structure made from flexible and watertight materials.

15. The nautical device according to claim 14, wherein the flexible and watertight materials comprise at least one of rubber, PVC, and Hypalon neoprene.

16. The nautical device according to claim 1, wherein the at least one auxiliary structure is made from flexible and watertight materials.

17. The nautical device according to claim 16, wherein the flexible and watertight materials comprise at least one of rubber, PVC, and Hypalon neoprene.

18. The nautical device according to claim 12, wherein the front structure, the secondary structure, and the two auxiliary structures comprise at least one inflatable structure made from flexible and watertight materials.

19. The nautical device according to claim 12, wherein the two auxiliary structures are made from flexible and watertight materials.

20. The nautical device according to claim 1, wherein:

the at least two secondary structures are generally cylindrical, and one end of each of the secondary structures is inserted into the front structure.

21. The nautical device according to claim 12, wherein:

the secondary structure is generally cylindrical, and one end of the secondary structure is inserted into the front structure.

22. A towable non-motorized nautical device for aquatic leisure activity having a front part that is capable of being lifted up from a liquid in which the nautical device is disposed when towed, said nautical device comprising:

an inflatable front structure elongated along a direction perpendicular to a direction of movement of the nautical device and comprising at least one closed end on a side of the nautical device;

at least one inflatable secondary structure having an end that is interlocked to an inner side of the front structure at a predetermined distance from the at least one closed end of the front structure;

at least one auxiliary structure with a cross section that is smaller than a cross section of the secondary structures, linking the secondary structures in a parallel manner; and at least one retainer for a passenger of the nautical device to hold on to;

wherein the secondary and auxiliary structures lie approximately parallel to each other along the direction of movement of the nautical device and are approximately perpendicular to the direction of elongation of the front structure, and wherein rear ends of the secondary and auxiliary structures are not linked.

* * * * *